US008556398B2

(12) United States Patent
Gunnell et al.

(10) Patent No.: US 8,556,398 B2
(45) Date of Patent: Oct. 15, 2013

(54) PRINTING SYSTEM WITH SELECTIVE HEATER ACTIVATION TO ENABLE INK FLOW TO A PRINTHEAD IN THE PRINTING SYSTEM

(75) Inventors: Reid Wayne Gunnell, Wilsonville, OR (US); David Paul Platt, Newberg, OR (US)

(73) Assignee: Xerox Corporation, Norwalk, CT (US)

( * ) Notice: Subject to any disclaimer, the term of this patent is extended or adjusted under 35 U.S.C. 154(b) by 332 days.

(21) Appl. No.: 12/947,556

(22) Filed: Nov. 16, 2010

(65) Prior Publication Data

US 2012/0120134 A1 May 17, 2012

(51) Int. Cl.
*B41J 2/175* (2006.01)

(52) U.S. Cl.
USPC ..... 347/88; 347/99

(58) Field of Classification Search
USPC ..... 347/88, 99
See application file for complete search history.

(56) References Cited

U.S. PATENT DOCUMENTS

| | | | | |
|---|---|---|---|---|
| 4,658,274 | A * | 4/1987 | DeYoung | 347/88 |
| 5,424,767 | A | 6/1995 | Alavizadeh et al. | |
| 5,606,355 | A | 2/1997 | Komatsu | |
| 5,635,964 | A | 6/1997 | Burr et al. | |
| 6,012,799 | A | 1/2000 | Silverbrook | |
| 6,359,701 | B1 | 3/2002 | Yamada et al. | |
| 6,386,674 | B1 | 5/2002 | Corrigan, III et al. | |
| 6,398,333 | B1 | 6/2002 | Mulay et al. | |
| 6,612,673 | B1 | 9/2003 | Giere et al. | |
| 7,341,324 | B2 | 3/2008 | Juve et al. | |
| 7,543,901 | B2 | 6/2009 | Snyder et al. | |
| 7,611,236 | B2 | 11/2009 | Park | |
| 2002/0018086 | A1 | 2/2002 | Kao et al. | |
| 2002/0047873 | A1 | 4/2002 | Imanaka et al. | |
| 2002/0057305 | A1 | 5/2002 | Kao et al. | |
| 2002/0060720 | A1 | 5/2002 | Kim et al. | |
| 2002/0145645 | A1 | 10/2002 | Aono et al. | |
| 2003/0189608 | A1 | 10/2003 | Hung et al. | |
| 2004/0196331 | A1 * | 10/2004 | Zerza et al. | 347/43 |
| 2005/0088474 | A1 | 4/2005 | Juve et al. | |
| 2007/0046710 | A1 | 3/2007 | Barkley et al. | |
| 2007/0046711 | A1 | 3/2007 | Barkley | |
| 2007/0047993 | A1 | 3/2007 | Brinsley | |
| 2009/0225124 | A1 | 9/2009 | Snyder et al. | |
| 2009/0273658 | A1 | 11/2009 | Freitag et al. | |
| 2010/0194834 | A1 | 8/2010 | Jones | |

FOREIGN PATENT DOCUMENTS

| | | |
|---|---|---|
| EP | 0 867 286 A3 | 3/2000 |
| GB | 2 407 299 A | 4/2005 |
| JP | 08-300684 | 11/1996 |

OTHER PUBLICATIONS

Machine English Translation of JP-08 300684A.*
UK Search Report of the UK Intellectual Property Office corresponding to GB Application No. GB0009294.5, UKIPO, Newport, South Wales, Mar. 7, 2012 (4 pages).

* cited by examiner

*Primary Examiner* — Julian Huffman
*Assistant Examiner* — Sharon A Polk
(74) *Attorney, Agent, or Firm* — Maginot, Moore & Beck, LLP

(57) ABSTRACT

A method for operating a printer having multiple printheads includes activating a heater that is operatively connected to a printhead that ejects ink having a single color in response to receiving a print job. The printer detects the presence of colors other than the single color in image data received in the print job, and activates heaters operatively coupled to printheads that eject ink drops that correspond to the detected colors.

5 Claims, 3 Drawing Sheets

PRINTING SYSTEM WITH SELECTIVE HEATER ACTIVATION TO ENABLE INK FLOW TO A PRINTHEAD IN THE PRINTING SYSTEM

TECHNICAL FIELD

The apparatus and method described below relate to heating ink, and more particularly to heating ink in an inkjet printing device.

BACKGROUND

Inkjet printers eject drops of liquid ink from inkjet ejectors to form an image on an image receiving surface, such as an intermediate transfer surface, or a media substrate, such as paper. Full color inkjet printers use a plurality of ink reservoirs to store a number of differently colored inks for printing. A commonly known full color printer has four ink reservoirs. Each reservoir stores a different color ink, namely, cyan, magenta, yellow, and black (CMYK) ink, for the generation of full color images.

Phase change inkjet printers utilize ink that remains in a solid phase at room temperature, often with a waxy consistency. After the ink is loaded into a printer, the solid ink is transported to a melting device, which melts the solid ink to produce liquid ink. The liquid ink is stored in a reservoir that may be either internal or external to a printhead. Multi-color printers may include multiple printheads with each printhead being fluidly connected to an ink reservoir to enable each printhead to receive and eject ink a single color of ink. An example of a common multi-color printer has a plurality of printheads that eject inks having the CMYK ink colors. Other multi-color systems may include one or more printheads that eject ink drops of multiple different colors from a single printhead. Printheads that eject more than one color of ink are supplied from multiple sources of ink. Additionally, these systems may also include at least one printhead configured to eject ink drops having a single color. In either type of printer, the liquid ink is provided to the inkjet ejectors of the printheads as needed.

In printers having a "sleep" mode, the amount of heat applied to ink reservoirs during periods of inactivity is lower than during imaging operations to reduce the consumption of electrical power in the printer. During sleep mode, melted ink may solidify. Upon receiving a request to print an image, all heating devices that apply heat to produce liquid ink in the reservoirs and printheads are activated to enable inkjet printing of liquid ink. Consequently, receipt of a request to print an image immediately increases the energy consumption of the printer from the energy consumption level occurring during the sleep mode. Reductions in the energy consumption of a printer are desirable.

SUMMARY

An improved method for operating a printer having multiple printheads has been developed. The method includes receiving a print job and activating a heater configured to heat only one printhead in a plurality of printheads in response to the print job being received. The only one printhead is configured to eject a single color of ink.

In at least one embodiment, an improved printer has been developed. The printer includes a plurality of printheads and a controller operatively connected to each printhead in the plurality of printheads. At least one of the printheads in the plurality of printheads is configured to eject only one color of ink and each printhead in the plurality of printheads has a heater configured to heat solid ink in the printhead to a phase change temperature. The controller is configured to activate a heater in at least one printhead configured to eject only one color of ink in the plurality of printheads in response to a print job being received by the printer.

In at least one other embodiment, an improved printer has been developed. The printer includes a plurality of printheads and a controller that is operatively connected to each printhead in the plurality of printheads. Each printhead in the plurality of printheads is configured to eject only one color of ink and each printhead in the plurality of printheads has a heater configured to heat solid ink to a phase change temperature. The controller is configured to activate at a heater in at least one printhead in the plurality of printheads in response to a print job being received by the printer.

In still another embodiment, an improved method of operating a printer having multiple printheads has been developed. The method includes receiving a print job, detecting at least one ink color in the print job, and activating a heater for each printhead configured to eject only one of the ink colors detected in the print job.

DETAILED DESCRIPTION

Figure 1:
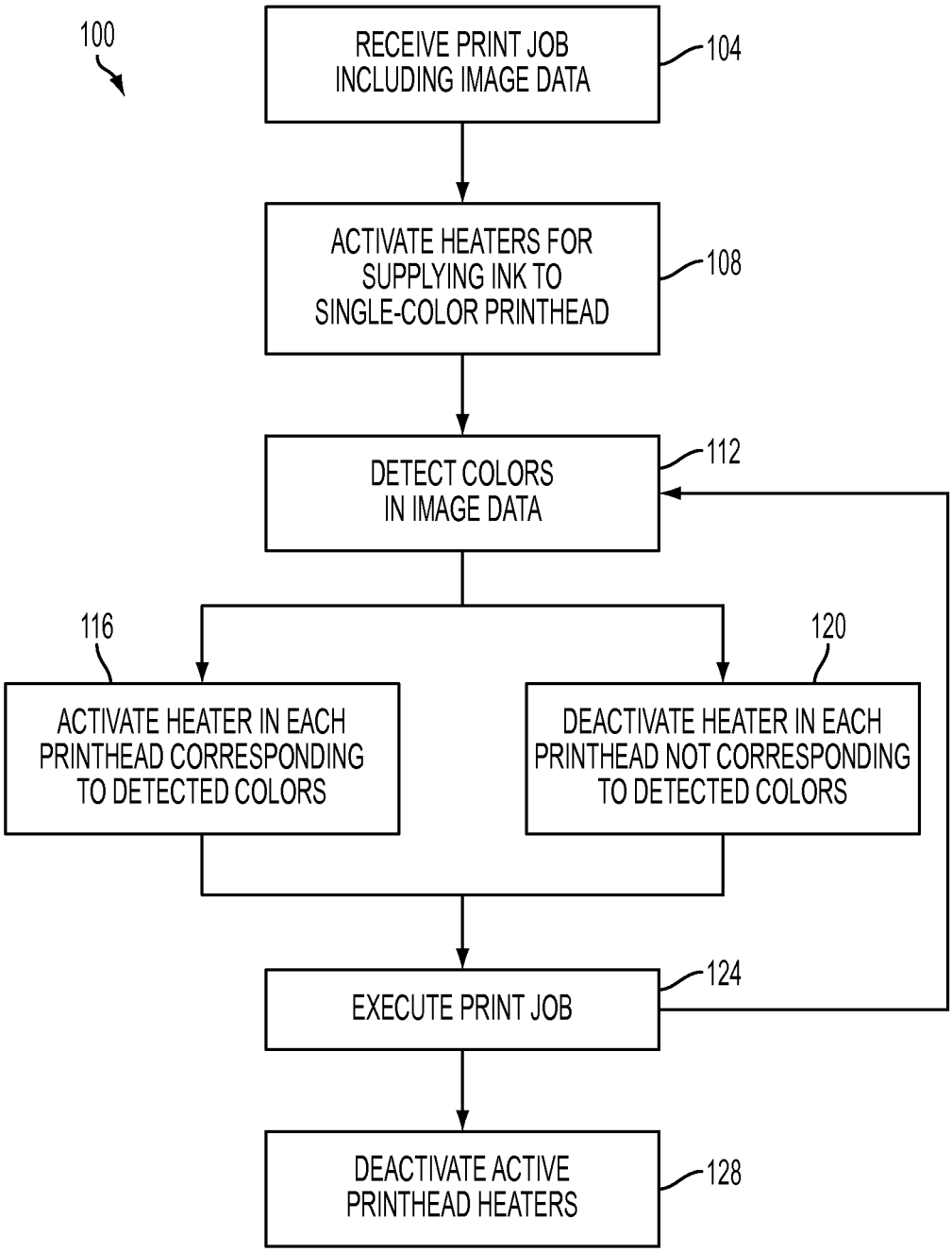
FIG. 1 is a block diagram of a method for selectively activating and deactivating heaters coupled to ink reservoirs in a plurality of printheads.

For a general understanding of the environment for the system and method disclosed herein as well as the details for the system and method, reference is made to the drawings. In the drawings, like reference numerals have been used throughout to designate like elements. As used herein the term "printer" refers to any device that is configured to eject a marking agent upon an image receiving member and include photocopiers, facsimile machines, multifunction devices, as well as direct and indirect inkjet printers that are configured to use phase-change, aqueous, solvent-based, or UV curable inks and the like. As used herein, the term "heater" refers to any device that is configured to generate heat, including electrical heaters incorporating one or more electrically resistive heating elements. As used herein the terms "activate" and "deactivate" when used with reference to a heater refer to operating modes of the heater. An activated heater generates an amount of heat sufficient to raise the temperature of at least one printer component such as a coupled inkjet printhead assembly or ink reservoir to an operating temperature that enables the printer component to produce, house, or eject liquid ink. A deactivated heater may generate no additional heat, or may generate heat that elevates the temperature of the coupled printer components to a temperature that is less than the operating temperature that enables the printer to produce, house, or eject liquid ink. As used herein the term "print job" refers to a series of data sent to a printer that specify commands and image data corresponding to one or more images for the printer to generate. Each image may include various elements such as text, graphics, and overlays, such as gloss coatings and watermarks. A print job may further include image data that specifies colors that correspond to one or more ink colors for use in generating the images. The printer forms images and performs various actions in accordance with data and commands in the print job to execute the print job.

FIG. 1 depicts a block diagram for a process 100 for selectively activating and deactivating ink reservoir heaters in a printer having multiple printheads. Process 100 begins when a printer receives a print job including image data (block 104). Upon receiving the print job, the printer activates one or more heaters that enable liquid ink to be ejected by a single-color printhead (block 108). A heater that is operatively connected to the single-color printhead activates in response to the printer receiving the print job. The single-color printhead heater may activate once the printer recognizes that a new print job request is being received, and need not wait for the printer to receive all data associated with the print job. Thus, for print jobs that are received over a longer period of time, such as several seconds or minutes, the printhead heater is activated prior to receiving the entire print job. The single-color printhead ejects ink having one color, and black is a common color for the single-color printhead because black ink is often used with greater frequency than inks having other colors in various imaging operations. In alternative configurations, single-color printheads may use colors other than black as well. Some printer configurations may omit the activation of heaters associated with any printheads until at least one ink color present in the image data is identified, as is described below.

In some embodiments of process block 108, two or more reservoirs may supply ink to one or more inkjet ejectors in the single-color printhead. For example, a smaller manifold reservoir may be positioned in the printhead near the inkjet ejectors to provide ink to the printhead quickly while a larger reservoir holds more ink that is supplied to the manifold reservoir through one or more conduits. The heater that is operatively connected to the printhead heats ink in the manifold reservoir as well as ink in inkjet ejectors of the printhead. A second heater that is operatively connected to the larger reservoir of ink that supplies the single-color printhead may also activate after waiting for a predetermined time period after activating the single-color printhead heater to provide additional ink to the manifold reservoir in the single-color printhead. In smaller print jobs, the manifold reservoir may have sufficient ink to execute a print job without requiring additional ink from the larger reservoir, while larger print jobs may use additional ink from the larger reservoir. The length of the time period to wait prior to activating the heater coupled to the larger reservoir may be set with reference to a level of ink present in the manifold reservoir.

Process 100 analyzes image data received as part of the print job to detect ink colors necessary for formation of the images specified in the print job (block 112). Various detection methods are suitable in response to the image data present in the print job. For example, the image data may directly identify ink colors for use in forming images, such as the cyan, magenta, yellow, and black (CMYK) colors or various other ink colors, such as spot colors and the like. In these situations, process 100 detects ink colors directly from the image data. Alternatively, image data may include color data that corresponds to ink colors in a printer in an indirect manner. For example, red, green, blue (RGB) image data do not directly correspond to ink colors in a CMYK printer, but the printer may translate the RGB image data to a corresponding CMYK color space using techniques that are known to the art. The printer then detects which colors of ink are present in a print job using the translated CMYK color data.

In response to detecting ink colors used in the print job, process 100 activates heaters in each printhead that correspond to the detected colors (block 116). In printers having multiple reservoirs, one or more heaters that are operatively coupled to larger reservoirs corresponding to the detected colors may also be activated after expiration of a time period in a manner similar to the processing described with reference to block 108. Process 100 may also deactivate heaters in printheads that hold ink colors that do not correspond to the detected colors (block 120). The deactivation of heaters may be optional in situations where the heaters that are operatively connected to printheads that correspond to non-detected colors are already deactivated. Once the activated heaters heat the single-color printhead and any printheads corresponding to detected inks to suitable operating temperatures, the printer executes the print job (block 124). Executing the print job may include ejecting ink drops to form one or more images on an image receiving member, such as an imaging drum, media sheets, or a continuous web. For print jobs that include a plurality of images, process 100 may periodically detect the ink colors in additional images, as described above with reference to block 112, to detect changes in ink colors used to form images in various portions of the print job. In this case, different heaters may be activated and deactivated in response to the detected image data as noted above in the processing of blocks 116 and 124. Detecting color content during a print job is useful in print jobs where certain ink colors may only be used for a portion of the print job, and also when the printer continues to receive image data corresponding to the print job after the printer has commenced executing the print job.

Upon completion of all pending print jobs, after expiration of a time period, the process 100 deactivates heaters in each of the printheads having activated heaters (block 128). Deactivating the heaters reduces energy usage in the printer. In one mode, the deactivated heaters apply no additional heat. In an alternative mode, the deactivated heaters may continue to apply heat to the printheads to maintain the temperature of the printheads at a level below the operating temperature and above the ambient temperature of the printer.

Figure 2:
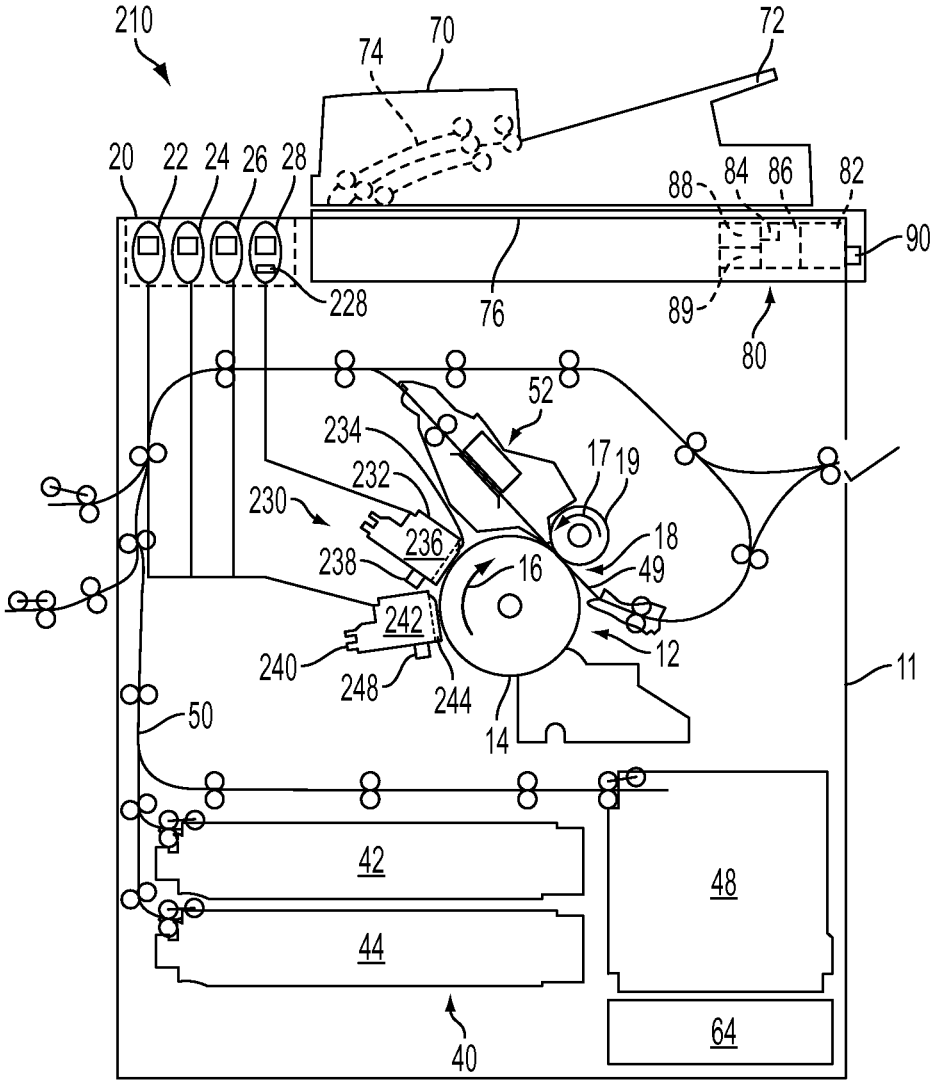
FIG. 2 is a schematic diagram of an inkjet printer having a single color printhead assembly and a multi-color printhead assembly.

FIG. 2 depicts an embodiment of a printer 210 including a single-color printhead assembly 232 and multi-color printhead assembly 240. As illustrated, the printer 210 includes a frame 11 to which is mounted directly or indirectly all its operating subsystems and components, as described below. The phase change ink printer 210 includes an imaging member 12 that is shown in the form of an imaging drum, but can equally be in the form of a supported endless belt. The imaging drum 12 has an image receiving surface 14 that is movable in the direction 16, and on which phase change ink images are formed. A transfix roller 19 rotatable in the direction 17 is loaded against the surface 14 of drum 12 to form a transfix nip 18 within which ink images formed on the surface 14 are transfixed onto a heated media sheet 49. An electrical power supply 64 provides electrical power to the various electronic and electromechanical components in the printer 210. In one embodiment, electrical power supply 64 converts an alternating current (AC) electrical current into one or more direct current (DC) electrical currents having various voltage and current levels.

Operation and control of the various subsystems, components and functions of the printer 210 are performed with the aid of a controller or electronic subsystem (ESS) 80. The ESS or controller 80, for example, is a self-contained, dedicated mini-computer having a central processor unit (CPU) 82 with electronic storage 84, and a display or user interface (UI) 86. The ESS or controller 80, for example, includes a sensor input and control circuit 88 as well as an ink drop placement and control circuit 89. In addition, the CPU 82 reads, captures, prepares and manages the image data flow associated with print jobs received from image input sources, such as the scanning system 76, or an online or a work station connection 90, and the printhead assemblies 232 and 240. As such, the ESS or controller 80 is the main multi-tasking processor for operating and controlling all of the other printer subsystems and functions, including the heating process 100 described above.

The controller 80 may be implemented with general or specialized programmable processors that execute programmed instructions, for example, printhead operation. The instructions and data required to perform the programmed functions may be stored in memory associated with the processors or controllers. The processors, their memories, and interface circuitry configure the controllers to perform the processes, described more fully below, that enable the generation and analysis of printed test strips for the generation of firing signal waveform adjustments and digital image adjustments. These components may be provided on a printed circuit card or provided as a circuit in an application specific integrated circuit (ASIC). Each of the circuits may be implemented with a separate processor or multiple circuits may be implemented on the same processor. Alternatively, the circuits may be implemented with discrete components or circuits provided in VLSI circuits. Also, the circuits described herein may be implemented with a combination of processors, ASICs, discrete components, or VLSI circuits.

The phase change ink printer 210 also includes a phase change ink delivery subsystem 20 that has multiple sources of different color phase change inks in solid form. Since the phase change ink printer 210 is a multicolor printer, the ink delivery subsystem 20 includes four (4) sources 22, 24, 26, 28, representing four (4) different colors CMYK (cyan, magenta, yellow, and black) of phase change inks. The phase change ink delivery subsystem also includes a melting and control apparatus (not shown) for melting or phase changing the solid form of the phase change ink into a liquid form. Each of the ink sources 22, 24, 26, and 28 includes a reservoir used to supply the melted ink to the printhead system 230. In the example of FIG. 2, ink source 28 supplies ink to a single-color printhead assembly 232 discussed in more detail below. A reservoir heater 228 coupled to the reservoir in ink source 28 and is configured to generate heat for ink in the ink source 28. The reservoir heater 228 may be embodied by a melt plate or it may be a separate heating device. Similar reservoir heaters may be included in ink sources 22, 24, and 26. Reservoir heater 228 is electrically connected to power supply 64. Controller 80 is operatively connected to reservoir heater 228 to activate or deactivate the reservoir heater 228 by controlling how much electrical current, if any, passes through the reservoir heater 228. In some embodiments, controller 80 may select from a plurality of electrical current levels to provide to the heater 228.

The phase change ink delivery subsystem is suitable for supplying melted ink to a printhead system 230 including single-color printhead assembly 232 and multi-color printhead assembly 240. Single-color printhead assembly 232 includes a manifold reservoir 236 and an array of inkjet ejectors 234. The manifold reservoir 236 holds a supply of black ink received from ink supply 28, and the manifold 236 supplies ink to the inkjet ejectors 234 that eject drops of the black ink onto image receiving surface 14. The single-color printhead assembly 232 includes a printhead heater 238 that is electrically connected to the electrical power supply 64. Controller 80 is operatively connected to printhead heater 238 to activate or deactivate the printhead heater 238 by controlling how much electrical current, if any, passes through the printhead heater 238. In some embodiments, controller 80 may select from a plurality of electrical current levels to provide to the printhead heater 238.

Multi-color printhead assembly 240 receives cyan, magenta, and yellow inks from ink sources 22, 24, and 26, respectively. The multi-color printhead assembly 240 includes separate manifold reservoirs 242 that supply each of the cyan, magenta, and yellow inks to one of a plurality of corresponding inkjet ejector arrays 244 for drop ejection onto the image receiving surface 14. Multi-color printhead assembly 240 includes a printhead heater 248 that is electrically connected to the power supply 64. Controller 80 is operatively connected to printhead heater 248 to activate or deactivate the printhead heater 248 by controlling how much electrical current, if any, passes through the printhead heater 248. In some embodiments, controller 80 may select from a plurality of electrical current levels to provide to the printhead heater 248. When activated, heater 248 provides the generated heat to each of the manifolds and inkjet ejector arrays in the multi-color printhead assembly 240.

The phase change ink printer 210 includes a substrate supply and handling subsystem 40. The substrate supply and handling subsystem 40, for example, may include sheet or substrate supply sources 42, 44, 48, of which supply source 48, for example, is a high capacity paper supply or feeder for storing and supplying image receiving substrates in the form of cut sheets 49, for example. The substrate supply and handling subsystem 40 also includes a substrate handling and treatment subsystem 50 that has a substrate heater or preheater assembly 52. The phase change ink printer 210 as shown may also include an original document feeder 70 that has a document holding tray 72, document sheet feeding and retrieval devices 74, and a document exposure and scanning subsystem 76.

In operation, the printer 210 receives a print job containing image data for one or more images from either the scanning subsystem 76 or via the online or work station connection 90. Controller 80 activates heater 238 in response to receiving the print job, and the heater 238 generates heat to enable printhead assembly 232 to eject molten drops of black ink. The heater 238 remains activated during the print job. Controller 80 may activate reservoir heater 228 after a predetermined timeout period to supply additional black ink to printhead assembly 232. Controller 80 also detects colors present in image data provided with the print job. If the image data only contain the single-color of printhead assembly 232, then controller 80 deactivates heater 248 during the print job. If the controller detects that the image data correspond to at least one of the colors in the multi-color printhead assembly 240, the controller 80 activates heater 248 to enable heating of all of manifold reservoirs in the printhead assembly 240 to eject molten ink drops of the at least one color. Additionally, the controller determines and/or accepts related subsystem and component controls, for example, from operator inputs via the user interface 86, and accordingly executes such controls.

Printhead assembly 232 and printhead assembly 240, when activated, eject ink drops onto selected locations of the imaging surface 14 to form ink images corresponding to the image data. Media sources 42, 44, 48 provide image receiving substrates that pass through substrate treatment system 50 to arrive at transfix nip 18 formed between the image receiving member 12 and transfix roller 19 in timed registration with the ink image formed on the image receiving surface 14. As the ink image and media travel through the nip, the ink image is transferred from the surface 14 and fixedly fused to the image substrate within the transfix nip 18. After completion of all received print jobs and expiration of a time period, controller 80 deactivates any activated heaters in the printhead assemblies 236 and 240.

Figure 3:
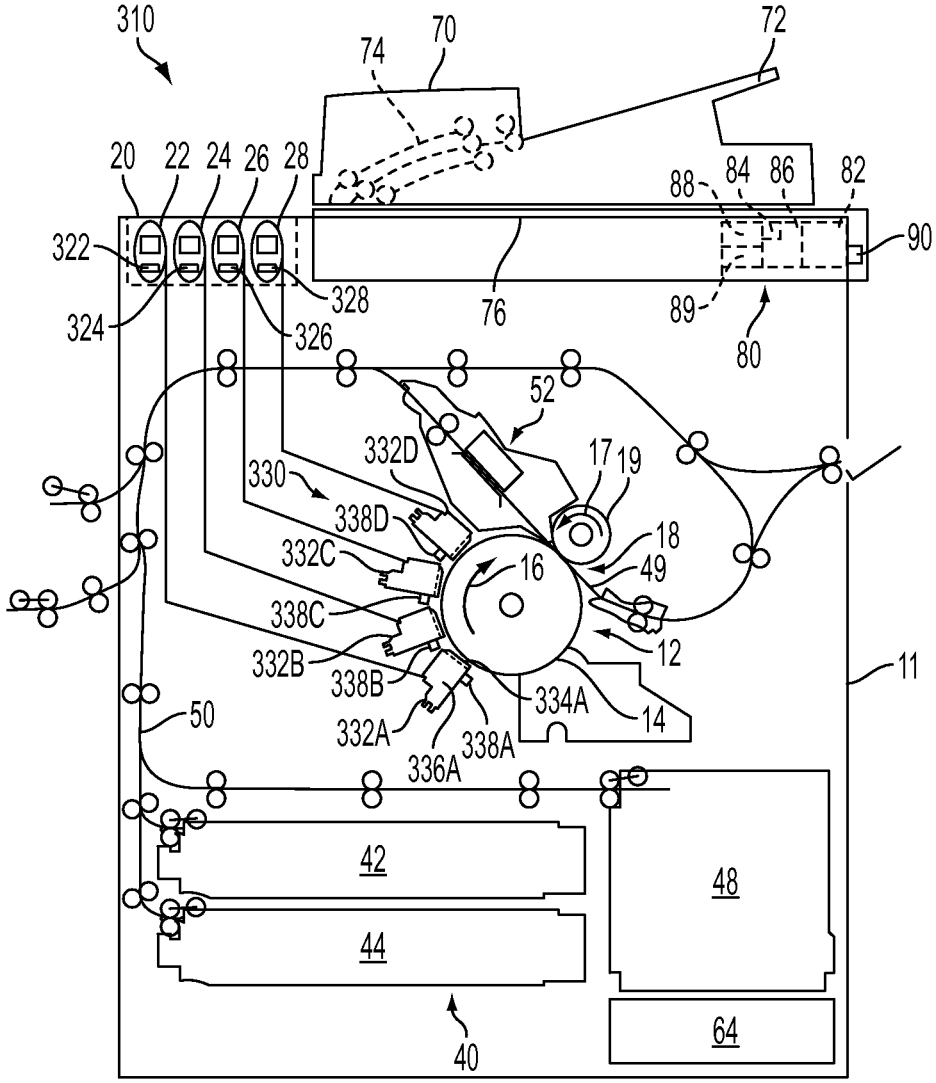
FIG. 3 is a schematic diagram of an inkjet printer having four printhead assemblies.

FIG. 3 depicts printer 310 including a printing system 330 having four single-color printhead assemblies 332A-332D. Printer 310 includes some components and subsystems that are similar to the printer 210 of FIG. 2, including the electronic subsystem 80, substrate supply and handling subsystem 40, substrate treatment subsystem 50, ink delivery subsystem 20, imaging drum 12, transfix roller 19, scanning subsystem 76, and power supply 64.

In the example of FIG. 3, each of the printhead assemblies 332A-332D is configured to eject ink drops having a single color onto image receiving surface 14. Each of the printhead assemblies 332A-332D includes an ink manifold and a plurality of inkjet ejectors, exemplified by manifold 336A and ejectors 334A in printhead assembly 332A. In the example embodiment of FIG. 3, printhead assemblies 332A-332D are each operatively connected one of ink sources 22-28, respectively. Consequently, printhead assemblies 332A-332D eject cyan, magenta, yellow and black ink drops, respectively. Printhead assemblies 332A-332D each includes one of heaters 338A-338D, respectively. Each of the heaters 338A-338D is electrically connected to the power supply 64 and heats in response to an electrical current passing through the heater. Controller 80 is operatively connected to each of heaters 338A-338D to activate or deactivate the heaters by controlling how much electrical current, if any, passes through each heater. Each of the ink sources 22-28 also includes one of reservoir heaters 322-328, respectively. Each of the reservoir heaters 322-328 is electrically connected to the power supply 64 and heats in response to an electrical current passing through the heater. Controller 80 is operatively connected to each of reservoir heaters 322-328 to activate or deactivate the reservoir heaters by controlling how much electrical current, if any, passes through each reservoir heater.

Controller 80 is configured to operate the heaters 338A-338D and reservoir heaters 322-328 in accordance with process 100 discussed above. Since each of the printhead assemblies 332A-332D is a single-color printhead assembly, the controller 80 may select any one of the printhead assembly heaters 338A-338D to activate in response to receiving a print job. The selection of the printhead assembly may be preprogrammed, selected by a user via the user interface 86, contained in print job data, or otherwise provided to the controller 80. In one embodiment, the default selected printhead assembly to heat in response to receiving a print job is the black ink printhead assembly 332D, but this selection may be changed to be any one of the cyan, magenta, or yellow printhead assemblies 332A-332C, respectively.

In operation, the printer 310 receives a print job containing image data for one or more images from either the scanning subsystem 76 or via the online or work station connection 90. Controller 80 activates the selected heater from the heaters 338A-338D in response to receiving the print job, and the selected heater generates heat to enable the corresponding one of printhead assemblies 332A-332D to eject molten drops of the selected ink color. The controller 80 may also activate one of reservoir heaters 322-328 for the ink source 22-28 that supplies ink to the selected printhead assembly after expiration of a predetermined time period to supply additional ink to the selected printhead reservoir while executing the print job. The heater coupled to the selected printhead remains activated during the print job. Controller 80 also detects colors present in image data provided with the print job. If any of the detected colors correspond to printheads other than the selected printhead, controller 80 activates the heaters in the printhead assemblies and corresponding ink source reservoirs for each of the detected ink colors. Controller 80 deactivates heaters in any printhead assemblies having ink colors that are not detected in the image data. Additionally, the controller determines and/or accepts related subsystem and component controls, for example, from operator inputs via the user interface 86, and accordingly executes such controls.

The selected printhead assembly and any remaining printhead assemblies 332A-332D corresponding to detected ink colors eject ink drops onto selected locations of the imaging surface 14 in accordance with the image data to form images on the image receiving surface 14. Media sources 42, 44, 48 provide image receiving substrates that pass through substrate treatment subsystem 50 to arrive at transfix nip 18 formed between the image receiving member 12 and transfix roller 19 in timed registration with the ink image formed on the image receiving surface 14. As the ink image and media travel through the nip, the ink image is transferred from the surface 14 and fixedly fused to the image substrate within the transfix nip 18. After completion of all received print jobs, and expiration of a time period, controller 80 deactivates heaters in each of the printhead assemblies 332A-332D.

In the embodiment shown in FIG. 3, the controller 80 may store information regarding the print jobs processed by the printer 310. This information may be statistically analyzed from time to time to identify a color of ink that is used alone to produce the output for a print job. This identified color may then be compared to the ink color corresponding to the printhead assembly that is activated automatically upon receipt of a print job. If the two colors are different, the controller 80 may modify the printhead assembly automatically activated upon receipt of a print job to the printhead assembly corresponding to the identified color. In this manner, the printer 310 is able to identify the single color print jobs most frequently encountered by the printer and adapt the automatic activation of printhead heaters accordingly.

It will be appreciated that variants of the above-disclosed and other features and functions, or alternatives thereof, may be desirably combined into many other different systems, applications or methods. For example, while the inkjet assemblies depicted herein have four arrays for four ink colors, alternative embodiments may include ejector arrays configured to use ink of various colors. While an indirect printer is described that applies ink to an image receiving member prior to transferring the image to a print medium, the foregoing methods may also be used in direct marking printers that apply ink directly to various print media including paper. Various presently unforeseen or unanticipated alternatives, modifications, variations or improvements therein may be subsequently made by those skilled in the art which are also intended to be encompassed by the following claims.

What is claimed:

1. A printer comprising:

a plurality of printheads, at least one of the printheads in the plurality of printheads being configured to eject a color of ink different than a color of ink ejected by the other printheads in the plurality of printheads and each printhead in the plurality of printheads having a heater configured to heat solid ink in the printhead to a phase change temperature;

a plurality of ink reservoirs, each reservoir having a heater and each reservoir being fluidly connected to only one printhead in the plurality of printheads to supply a single color of ink to the printhead and each ink reservoir being fluidly connected to the plurality of printheads in a one-to-one correspondence; and a controller operatively connected to each printhead in the plurality of printheads, the controller being configured to detect ink colors in a print job received by the printer and to activate only the heater in each printhead configured to eject a color of ink detected in the print job being received by the printer, and the controller being further configured to activate only the heater for at least one reservoir that supplies ink to at least one printhead that ejects an ink color detected in the print job after expiration of a predetermined time period following the activation of the heater for the at least one printhead that ejects an ink color detected in the print job.

2. The printer of claim 1, the controller being further configured to activate a heater in the printhead configured to eject black ink as well as the heaters in the print heads ejecting ink colors detected in the print job received by the printer.

3. The printer of claim 1, the controller being further configured to deactivate each heater in each printhead in the plurality of printheads that ejects an ink color not detected in the print job.

4. A printer comprising:

a plurality of printheads, each printhead in the plurality of printheads being configured to eject only one color of ink and each printhead in the plurality of printheads having a heater configured to heat solid ink to a phase change temperature;

a plurality of ink reservoirs, each reservoir having a heater and each reservoir being fluidly connected to only one printhead in the plurality of printheads to supply a single color of ink to the printhead and each ink reservoir being fluidly connected to the plurality of printheads in a one-to-one correspondence; and a controller operatively connected to each printhead in the plurality of printheads, the controller being configured to detect ink colors in a print job received by the printer and to activate only the heater for each printhead in the plurality of printheads that ejects an ink color detected in the print job received by the printer, and the controller being further configured to activate the heater for at least one reservoir that supplies ink to at least one printhead that ejects an ink color detected in the print job after expiration of a predetermined time period following the activation of the heater for the at least one printhead that ejects an ink color detected in the print job.

5. The printer of claim 4 wherein the controller is further configured to activate the heater in the printhead configured to eject black ink as well as the heaters in for each printhead that ejects an ink color detected in the print job.

* * * * *